US008632129B2

(12) United States Patent
Huttenhuis

(10) Patent No.: US 8,632,129 B2
(45) Date of Patent: Jan. 21, 2014

(54) ADJUSTABLE BACKREST

(75) Inventor: Alouisius Gerardus Huttenhuis, Denekamp (NL)

(73) Assignee: PR Sella B.V., Oldenzaal (NL)

( * ) Notice: Subject to any disclaimer, the term of this patent is extended or adjusted under 35 U.S.C. 154(b) by 503 days.

(21) Appl. No.: 12/810,657

(22) PCT Filed: Dec. 30, 2008

(86) PCT No.: PCT/NL2008/050860
§ 371 (c)(1),
(2), (4) Date: Jul. 9, 2010

(87) PCT Pub. No.: WO2009/084961
PCT Pub. Date: Jul. 9, 2009

(65) Prior Publication Data

US 2010/0276974 A1 Nov. 4, 2010

(30) Foreign Application Priority Data

Dec. 31, 2007 (NL) ..... 2001148

(51) Int. Cl.
*A47C 7/00* (2006.01)

(52) U.S. Cl.
USPC ..... 297/440.2; 297/284.3; 297/284.4; 297/284.7; 297/284.8

(58) Field of Classification Search
USPC ..... 297/440.2, 284.3, 284.4, 284.5, 284.7, 297/284.8, 353, 354.11
See application file for complete search history.

(56) References Cited

U.S. PATENT DOCUMENTS

| | | | | | |
|---|---|---|---|---|---|
| 336,387 | A | * | 2/1886 | Child | 297/271.2 |
| 2,799,323 | A | | 7/1957 | Berg | |
| 3,749,442 | A | | 7/1973 | Berg et al. | |
| 4,475,770 | A | | 10/1984 | Persons | |
| 4,647,066 | A | * | 3/1987 | Walton | 297/284.1 |
| 4,711,492 | A | * | 12/1987 | Asbjornsen et al. | 297/284.7 |
| 4,862,536 | A | * | 9/1989 | Pruit | 297/284.5 |
| 4,981,325 | A | * | 1/1991 | Zacharkow | 297/284.1 |
| 5,024,485 | A | | 6/1991 | Berg et al. | |
| 5,228,747 | A | * | 7/1993 | Greene | 297/284.3 |
| 5,288,127 | A | | 2/1994 | Berg et al. | |
| 5,407,248 | A | * | 4/1995 | Jay et al. | 297/284.1 |
| 5,449,214 | A | * | 9/1995 | Totani | 296/68.1 |

(Continued)

FOREIGN PATENT DOCUMENTS

| | | | |
|---|---|---|---|
| EP | 1256333 | A2 | 11/2002 |
| EP | 1486140 | A | 12/2004 |

(Continued)

*Primary Examiner* — David Dunn
*Assistant Examiner* — David E Allred
(74) *Attorney, Agent, or Firm* — Morgan, Lewis & Bockius LLP

(57) ABSTRACT

A backrest for supporting the back of a seated person, intended and adapted to form part of an article of seating furniture, such as a wheelchair, has the feature that the backrest consists of two parts, that is: a lower backrest part for supporting the sacral-lumbar part of the back of a seated person, and an upper backrest part for supporting the lumbar-thoracic part of the back of a seated person; both backrest parts can be moved independently of each other relative to the carrier; and a carrier therefor which has three degrees of freedom in a vertical plane, perpendicularly of the main plane of the backrests, relative to the frame tube, i.e. two degrees of freedom of translation corresponding to height and depth, and one degree of freedom of rotation around a horizontal rotation axis.

13 Claims, 8 Drawing Sheets

(56) References Cited

U.S. PATENT DOCUMENTS

| | | | | |
|---|---|---|---|---|
| 5,556,168 | A * | 9/1996 | Dinsmoor et al. | 297/440.2 |
| 5,564,784 | A | 10/1996 | Felling | |
| 5,580,128 | A | 12/1996 | Johnson et al. | |
| 5,593,211 | A * | 1/1997 | Jay et al. | 297/383 |
| 5,906,416 | A * | 5/1999 | Rasmussen | 297/452.33 |
| 5,913,568 | A | 6/1999 | Brightbill et al. | |
| 6,095,611 | A * | 8/2000 | Bar et al. | 297/440.21 |
| 6,257,664 | B1 | 7/2001 | Chew et al. | |
| 6,688,693 | B2 * | 2/2004 | Griffiths et al. | 297/354.12 |
| 7,237,848 | B1 * | 7/2007 | Story et al. | 297/485 |
| 7,350,865 | B2 | 4/2008 | Pearse | |
| 7,387,339 | B2 | 6/2008 | Bykov et al. | |
| 7,857,394 | B2 * | 12/2010 | Whelan et al. | 297/440.2 |
| 2003/0102706 | A1 | 6/2003 | Float et al. | |
| 2004/0256899 | A1 * | 12/2004 | Moore et al. | 297/284.3 |
| 2005/0116527 | A1 | 6/2005 | Leguen et al. | |
| 2006/0238006 | A1 * | 10/2006 | Baranov et al. | 297/284.3 |
| 2006/0255635 | A1 * | 11/2006 | Iijima et al. | 297/284.3 |
| 2008/0067850 | A1 * | 3/2008 | Stenstrom et al. | 297/353 |
| 2008/0157581 | A1 * | 7/2008 | Whelan et al. | 297/440.2 |
| 2008/0284222 | A1 * | 11/2008 | Draeger et al. | 297/284.3 |
| 2009/0072105 | A1 * | 3/2009 | Cramer | 248/226.11 |
| 2010/0289310 | A1 * | 11/2010 | Huttenhuis | 297/311 |
| 2012/0223560 | A1 * | 9/2012 | Hetzel et al. | 297/285 |
| 2012/0326482 | A1 * | 12/2012 | Goeckel | 297/440.2 |

FOREIGN PATENT DOCUMENTS

| | | | | |
|---|---|---|---|---|
| JP | 06072201 | A * | 3/1994 | B60N 2/22 |
| JP | 06072203 | A * | 3/1994 | B60N 2/22 |
| WO | Wo 95/15101 | A1 | 6/1995 | |
| WO | WO 99/17636 | | 4/1999 | |
| WO | WO 03/063650 | A | 8/2003 | |
| WO | WO 2009084962 | A1 * | 7/2009 | A47C 7/14 |

* cited by examiner

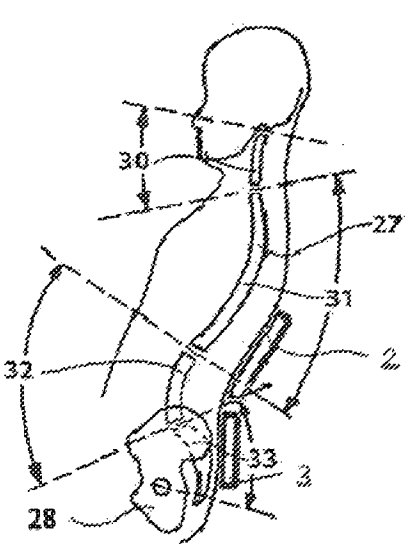
FIG. 7a
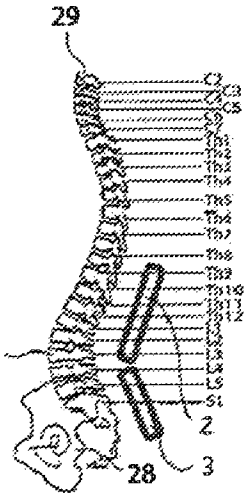
FIG. 7b
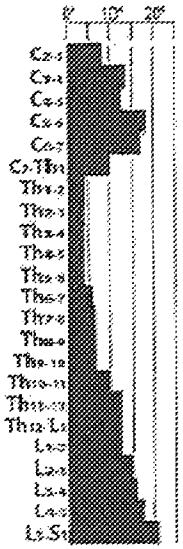
FIG. 7c
FIG. 7d

ADJUSTABLE BACKREST

The invention relates to a backrest for supporting the back of a seated person, which backrest is intended and adapted to form part of an article of seating furniture, such as a chair or a couch, a seat for a means of transport such as a car, a bus or an aircraft, or a wheelchair.

Such a backrest is for instance known from WO-A-2001/060209. This known backrest is coupled to a seat part.

US-A-2003/0102706 relates to a quick release backrest. Both publications describe a backrest which is divided into parts hingedly connected to each other. Research has shown that a uniform pressure distribution cannot be realized with such a hinge coupling between the two parts, whereby the results obtained with this backrest leave something to be desired.

It is an object of the invention to modify a backrest of the known type such that an anatomically correct stability of the torso of a seated person is realized, whereby the muscle tensioning and the internal load on joints and ligaments is kept as low as possible. If a seat part offers no, or at least insufficiently stable torso support, the body of the seated person will assume a posture such that the load on joints and muscles becomes undesirably great. Seated persons who are at least more or least forced to sit for prolonged periods and are not provided with an anatomically correct stable torso posture, experience sitting-related problems as a result. These problems manifest themselves in restless sitting behaviour, pain in the neck and the shoulders, pain in the lower back, pain in the seat area and fatigue symptoms.

In the longer term this undesirable sitting behaviour may manifest itself in for instance a possibly permanent curvature of the spinal column, so-called scoliosis, open wounds on the seat area, the so-called decubitus, particularly on the tail bone (the os coccyx) as a result of a pronounced backward tilting of the pelvis, in combination with impaired functioning of organs, such as for instance liver and kidneys, due to constant excessive load on the abdomen content. Communicating with their surroundings also demands extra energy of the seated person, and this can even result in social isolation.

Existing backrests with lumbar supports and side pads do not provide anatomically correct torso stability and therefore provide hardly any or no improvement.

The individual curvature of the backrest is often realized by arranging an extra lumbar support or by making such a lumbar support adjustable. Such a solution also provides insufficient result.

The invention is based on the insight that the sacral-lumbar part of the back and the lumbar-thoracic part of the back of the seated person must each occupy a correct position in order to achieve said desired stable torso support.

With a view to this objective, the invention provides a backrest of the type stated in the preamble, this backrest having the feature that the backrest consists of two parts, that is:

- a lower backrest part for supporting the sacral-lumbar part of the back of the seated person, and
- an upper backrest part for supporting the lumbar-thoracic part of the back of a seated person;

both backrest parts can be moved independently of each other;

relative to the frame tube the carrier has three degrees of freedom in a vertical plane perpendicularly of the main plane of the backrests, i.e. two degrees of freedom of translation corresponding to height and depth, and one degree of freedom of rotation around a horizontal rotation axis;

relative to the carrier the lower backrest part has three degrees of freedom in a vertical plane perpendicularly of the main plane of the backrest parts, i.e. two degrees of freedom of translation corresponding to height and depth, and one degree of freedom of rotation around a horizontal rotation axis;

relative to the carrier the upper backrest part has one degree of freedom in a vertical plane perpendicularly of the main plane of the backrest parts, i.e. rotation around a horizontal rotation axis;

adjusting means are present for adjusting the spatial position of each of the backrest parts and the carrier; and locking means are present for fixing the carrier and each of the backrest parts in a chosen spatial position.

The backrest according to said American patent US-A-2003/0102706 does provide the option of adjusting the depth of the lower backrest part without temporarily unlocking, and thereby disrupting, the setting of the upper backrest part, and vice versa.

According to the invention it is deemed essential that the therapist and/or user is able, after adjusting the upper backrest part, to move the lower backrest part independently of the upper part, i.e. a change in the spatial position of the lower backrest part does not affect that of the upper backrest part.

In anticipation of the description following below relating to a functional backrest angle, it is already noted here that an anatomically correct torso stability starts at a functional backrest angle ($\nu+\forall$) of about 115° of the lumbar-thoracic backrest part.

In a preferred embodiment the backrest has the special feature that an angle measuring device is added to at least one of the backrest parts with which the angular position of the relevant backrest parts can be measured and read, for instance a spirit level. It is particularly important when in the latter described embodiment an angle measuring device is added to at least the upper backrest part. Such an instrument gives the user and/or to the therapist visual information about the qualitative and quantitative angular position of the relevant backrest part.

In order to transfer the weight force of the torso in the most advantageous biomechanical manner to the pelvis, this pelvis must be tilted forward to some extent. This tilting is obtained by exerting forces on the pelvis whereby it undergoes said forward tilting. Tilting of the pelvis is realized by causing the lower backrest part to exert a uniformly distributed pressure on the sacral-lumbar vertebrae of the spinal column of the seated person.

A non-uniform pressure distribution in this zone results in shear forces in the intervertebral discs and is for this reason undesirable. Such a pressure distribution can result in pain symptoms and in extreme cases, after a longer period of time, cause permanent deformities with all the adverse consequences this involves.

According to a specific aspect of the invention, the backrest can have the special feature that the degrees of freedom are independent of each other. This should be understood to mean that for instance a rotation of a backrest part does not result in a corresponding translation and vice versa, while the one translation also has no effect on the translation position in the other degree of freedom.

It is noted here that a pure rotational degree of freedom corresponds to a spatially fixed pure rotation axis. According to the invention however, use can also be made of determined practical support mechanisms, using which the desired rotation of a backrest part can take place, but wherein strictly speaking pure rotation may not be involved but possibly pivoting, which is accompanied by changes in the translation position which may or may not be negligible in one of the translation degrees of freedom, and vice versa. This aspect will also be discussed later in this specification. In the case where not one single pure rotation axis is defined, it is better to refer to a "pivot zone".

According to yet another aspect of the invention, the backrest can have the special feature that the adjusting means are of mechanical, pneumatic or electrical type.

According to yet another aspect of the invention, the backrest has the special feature that the backrest is carried by a frame comprising mounting means for mounting on an article of seating furniture, such as a chair or a couch, a seat for a means of transport such as a car, a bus or an aircraft, or a wheelchair.

It may be important in some circumstances for the frame to be embodied such that it is provided with armrests.

In order to avoid discomfort for a seated person as much as possible while maintaining the anatomically correct torso stability which can be realized with the backrest according to the invention, the backrest can have the special feature that both backrest parts are provided on their front side with a pressure-distributing layer.

During use the backrest according to the invention can be used as replacement for an existing backrest, for instance one which does not function well, in for instance wheelchairs, car seats or office chairs. Wheelchairs in particular are characterized by their modular construction, wherein the seat part and the backrest can be added as modules to a modular frame to form a complete seating provision. It is usual for a frame of for instance brand A to be applied in combination with a seat part of brand B and a backrest of brand C, in accordance with the specific properties of each module. The invention makes it possible to provide many existing chairs, in particular wheelchairs, which do no provide good back support, with a good backrest providing excellent and anatomically correct stability to the torso.

It is known from research that an anatomically correct torso stability starts at a functional backrest angle ($\nu+\forall$) of about 115°. See for this purpose FIG. 5, which is already referred to here. Reference is made in respect of this research to the book by dr. ir. H.A.M. Staarink "Zo zit het!" ISBN 978 90 232 4341. The stated stability concept can be further elucidated on the basis of a model of the human body. FIG. 6*a* thus shows a model of the human body as developed by the above stated author, dr. ir. H.A.M. Staarink. The model is chosen such that feet, lower legs, upper legs, pelvis, torso, head, upper arms, lower arms and hands are represented by non-deformable elements, each having its own mass centre. The body parts of the model are mutually connected by means of hinges. In said FIG. 6*a* the model of the seated person is supported by a seat part, a backrest, a footrest and an armrest. The pelvis is assumed to be pivoting on the support surface of the seat part at a point designated with T, the so-called tuber.

A correct backrest must provide stable support. Research has shown that a stable support of the torso by a functional backrest part which only supports the vertebral area from the third lumbar (L3) up to and including the ninth thoracic (T9), see FIG. 1*b*, must lie at least at a functional backrest angle ($\nu+\forall$) of about 115° (see FIG. 5). This angle is realized or created when the mass centre M of the torso lies behind the vertical line through S (see FIG. 6*b*).

In the case where the mass centre M of the torso lies directly above S, there is a labile situation. When mass centre M of the torso lies in front of the vertical through S, there is no support and the torso falls forward in uncontrolled manner unless the seated person keeps his/her back muscles permanently tensioned. This latter is of course undesirable. In the two last mentioned situations a backrest is not functional since it is not able to provide or absorb any force.

Support of the lower part of the back, i.e. the vertebrae below the third lumbar (L3) and the sacral part, is of essential importance in "orienting" of this part. Two reasons can be given for this. Firstly, it is important to follow and guide the curvature of the vertebrae for a mutual uniform pressure between the vertebrae. Secondly, it is important to reduce the pressure on the tubera by tilting the pelvis a little forward.

In a correct sitting support the pelvis must have a position such that a straight line can be drawn through S, T and the mass centre M of the torso. Such a posture causes minimal load on the vertebrae, the ligaments of the spinal column and the back muscles.

Research has further shown that the head is balanced on the torso at a functional backrest angle ($\nu+\forall$) of about 115°. If the functional backrest angle ($\nu+\forall$)>123°, the head will tilt backward if it is not supported. This situation is referred to as the beginning of a lying posture. An anatomically correct back support for seated persons therefore occurs at a functional backrest angle ($\nu+\forall$) between about 115° and about 123°.

Research has further shown that it is desirable for the static variation in the vertebral load to be as low as possible, since variations in the static vertebral load cause additional shear forces between the vertebrae. This is perceived as unpleasant. In this respect it is important according to the invention that the lower backrest part, which supports the lumbar-sacral back part of the seated person, is adjusted such that a uniform load is exerted on this part of the spinal column.

In order to enhance user awareness of their posture and also to indicate a qualitative estimate of the functional backrest angle ($\nu+\forall$), use can advantageously be made of said angle measuring device or devices. An angle measuring device can particularly give the user and/or a therapist a visual indication in respect of the set functional backrest angle ($\nu+\forall$) which, as stated, must be in the range between about 115° and 123°.

People with problems are often consciously involved in their rehabilitation. The angle measuring device provides the users with an aid for the purpose of checking and, if necessary, adjusting the seat angle themselves.

The invention will now be elucidated with reference to the accompanying drawings. In the drawings.

Figure 2:
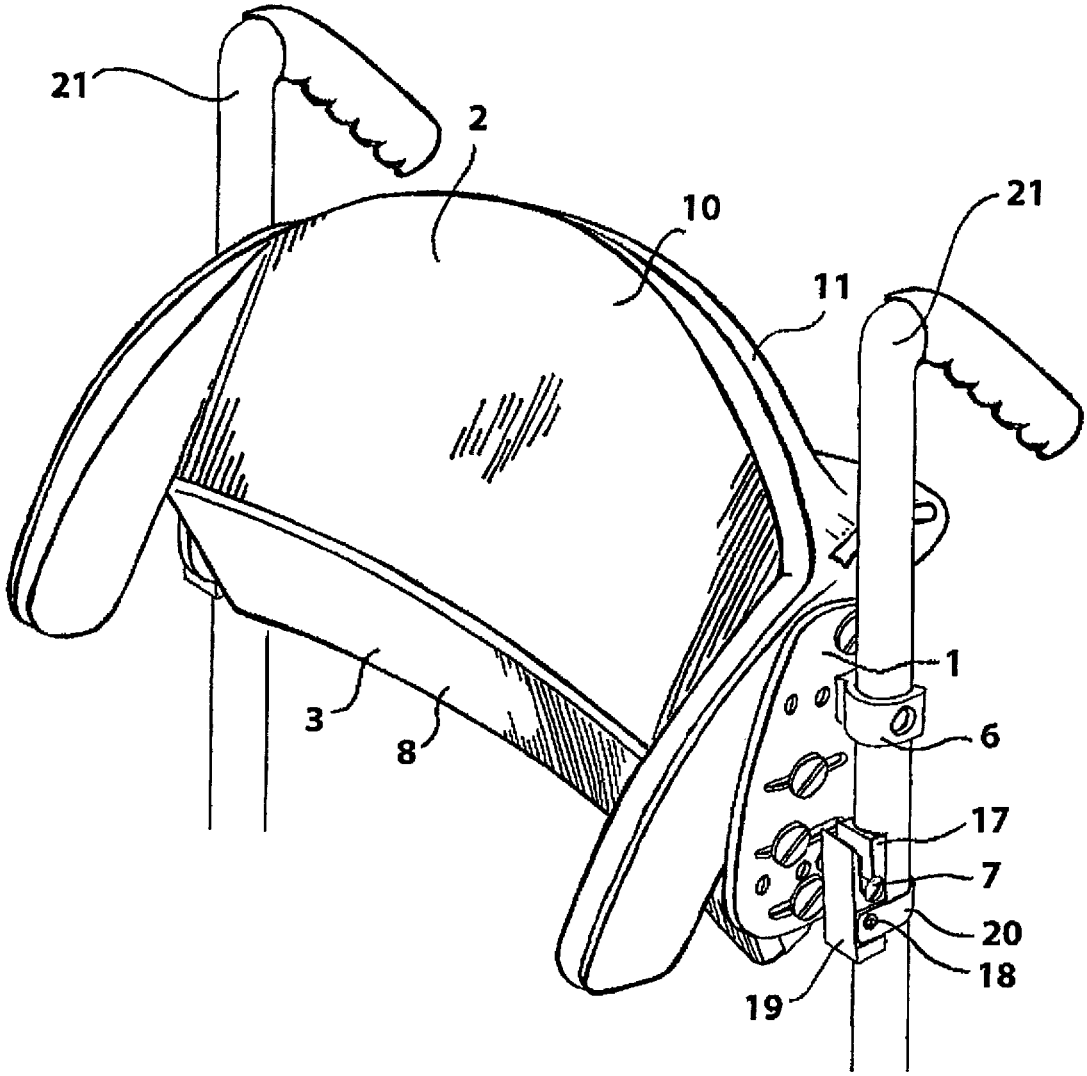
FIG. 2 shows a perspective view of a backrest according to the invention, connected to wheelchair frame tubes.
Figure 4C:
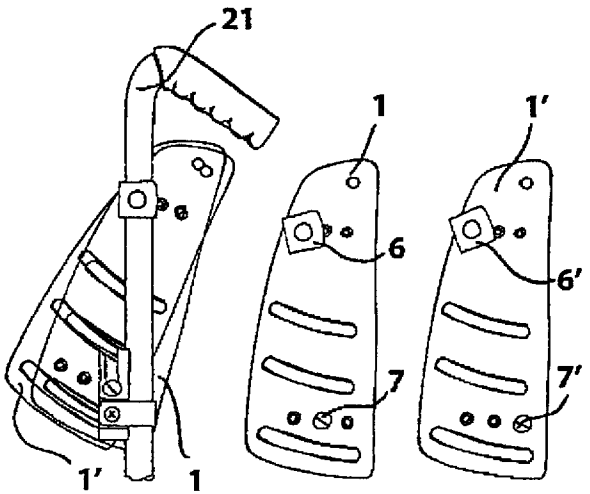
Figure 4B:
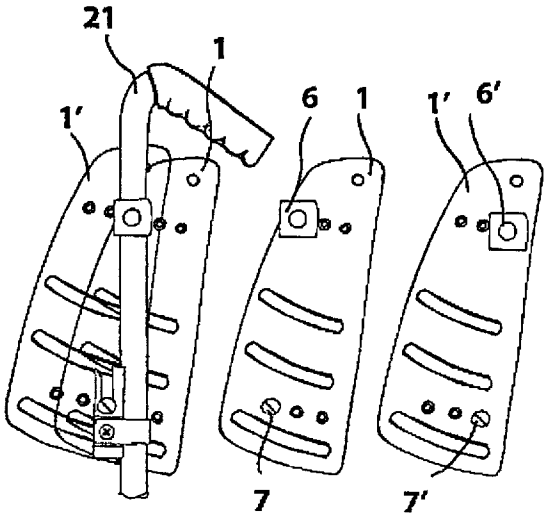
Figure 4A:
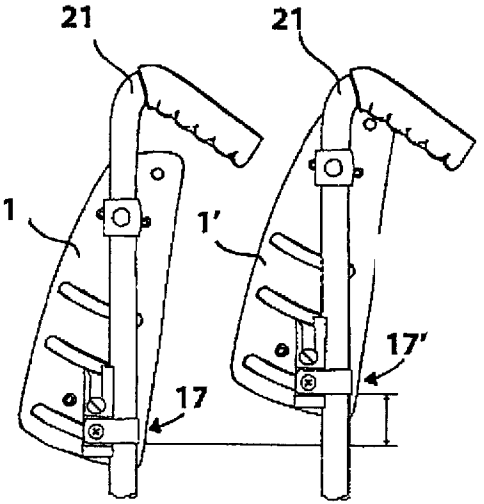
Figure 5:
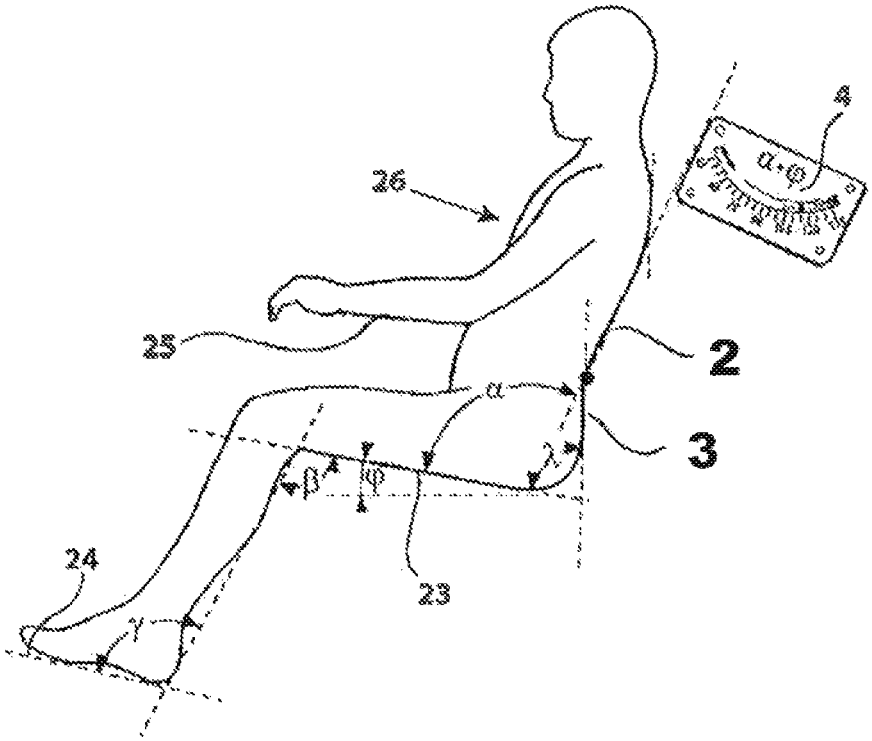
Figure 6A:
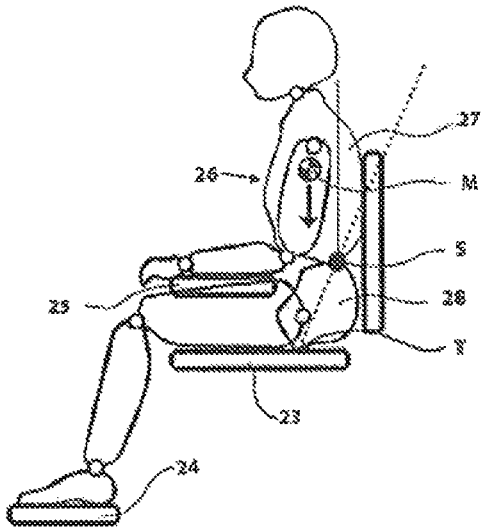
Figure 6B:
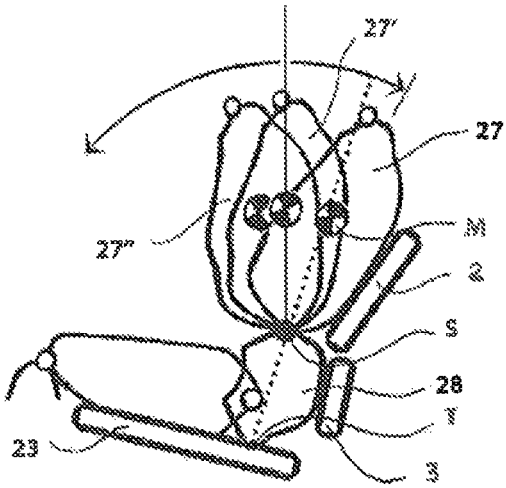
Figure 8A:
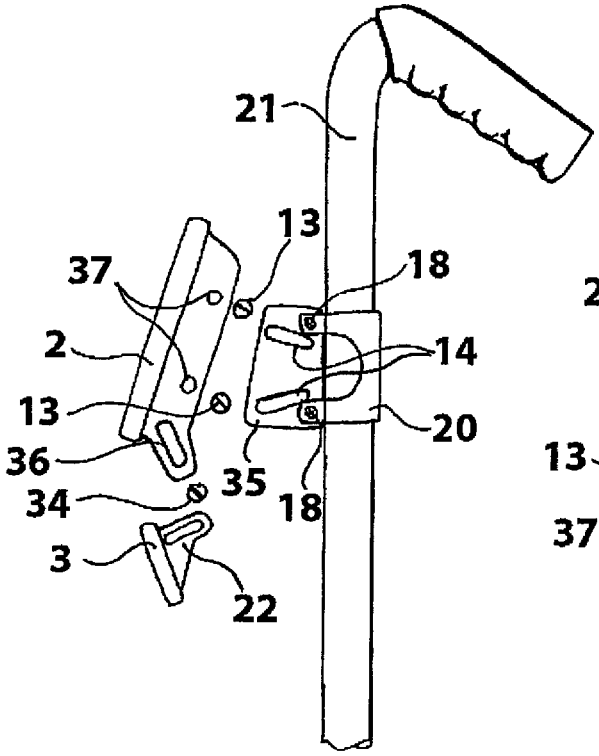
Figure 8B:
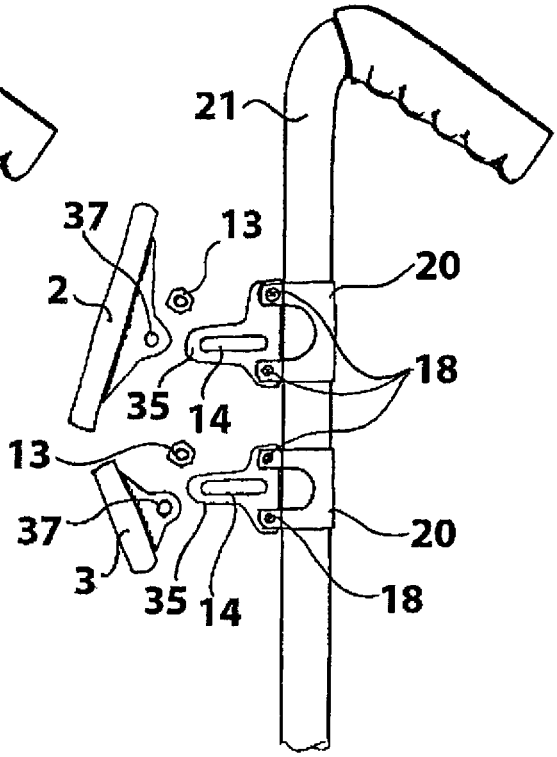
Figure 8C:
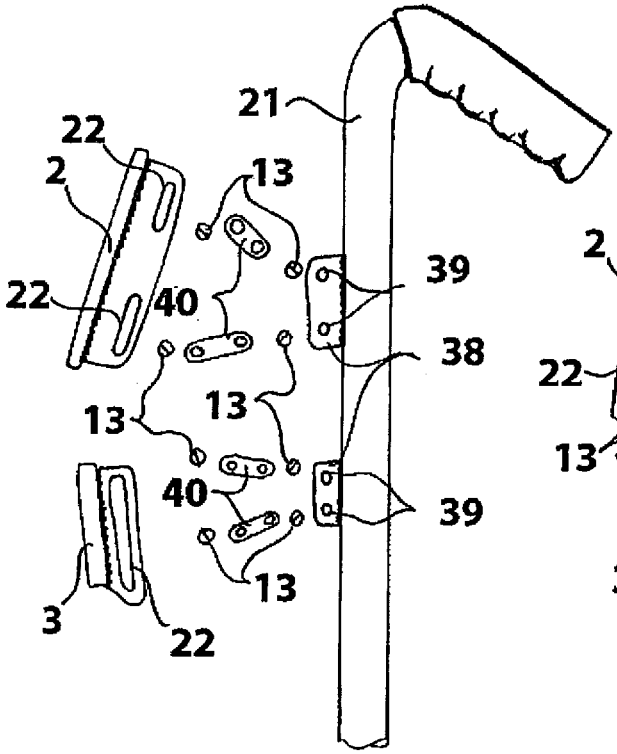
Figure 8D:
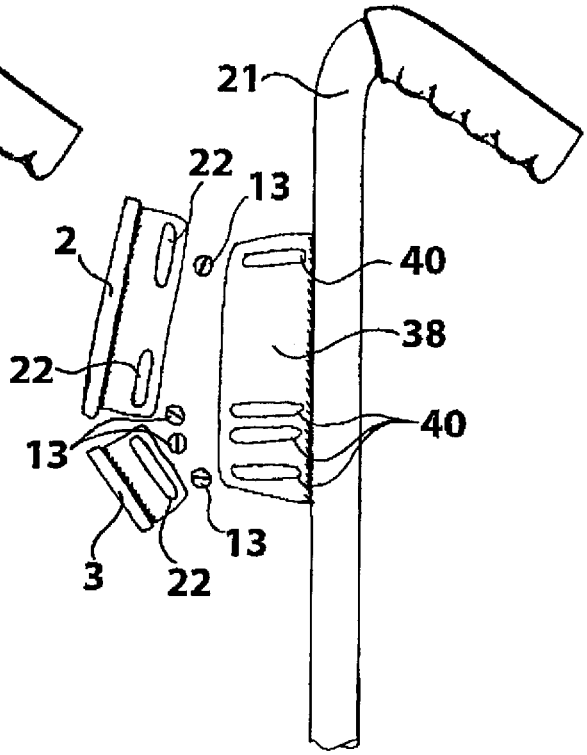

FIG. 4*a* shows a side view of a part of the backrest according to FIG. 2 which indicates how the height adjustment of the carrier 1 is possible;

FIG. 4*b* shows a side view of a part of the backrest according to FIG. 2 which indicates how the depth adjustment of the carrier 1 is possible;

FIG. 4*c* shows a side view of a part of the backrest according to FIG. 2 which indicates how the angular adjustment of the carrier 1 is possible;

FIG. 5 is a schematic side view of a seat part in combination with a backrest and a seated person, elucidating the relevant angles;

FIG. 6*a* shows a model of the human body in the manner of FIG. 5 in accordance with the stated book "Zo zit het" by dr. ir. H.A.M. Staarink, in which a straight and unstable back support is drawn;

FIG. 6*b* shows a view essentially corresponding to FIG. 6*a* of a seat part with a divided backrest according to the invention, elucidating a non-supported position, a labile position and a stable position;

FIG. 7*a* shows a model of a seated person corresponding to FIG. 6*a*, for defining the pivot point S;

FIG. 7*b* shows a schematic representation of a spinal column with a lumbar-thoracic support and a sacral-lumbar support;

FIG. 7*c* shows a graphic representation of the relative freedom of the angle of flexure of all vertebrae of the spinal column;

FIG. 7*d* shows a schematic representation of a seated person in which the spinal column is drawn divided into four segments, with a sacral-lumbar and a lumbar-thoracic backrest according to the invention;

FIG. 8*a* shows a schematic representation of a possible adjusting mechanism for the backrest according to the invention;

FIG. 8*b* shows another embodiment;

FIG. 8*c* shows another further embodiment;

FIG. 8*d* shows yet another embodiment.

Figure 1:
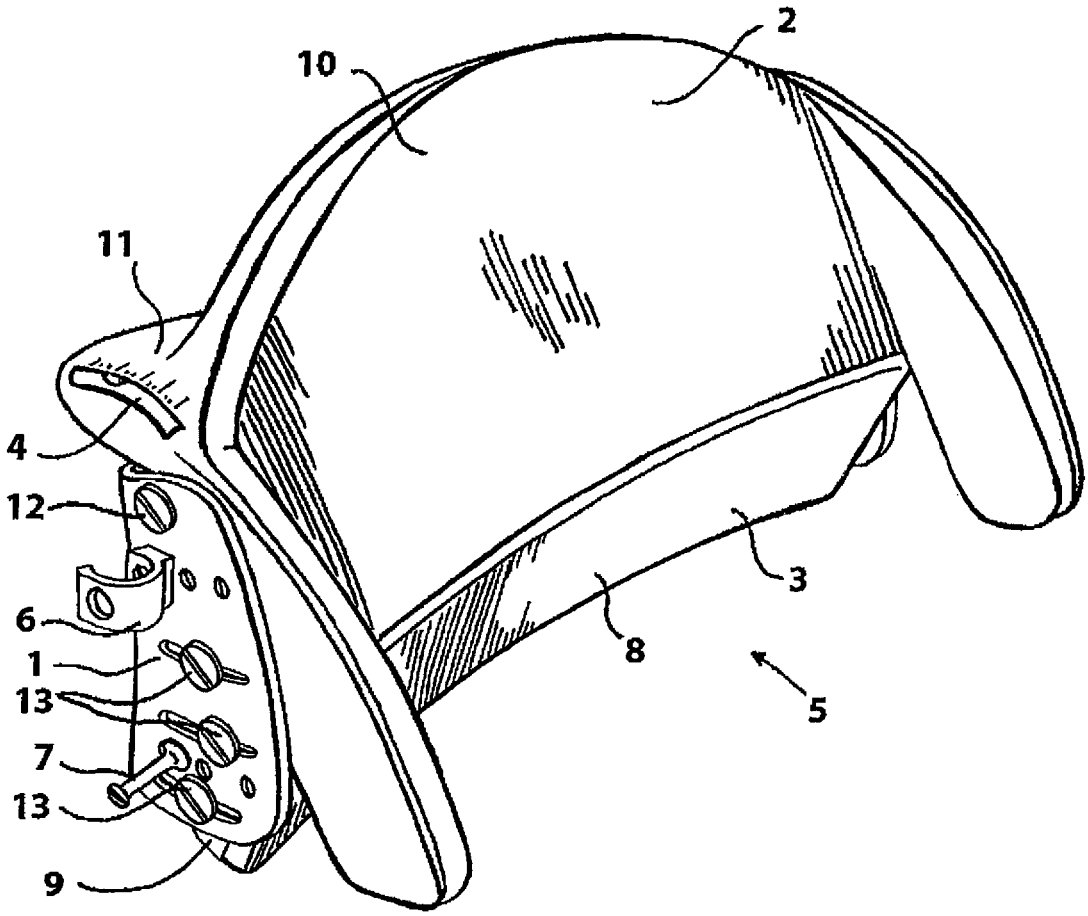
FIG. 1 shows a perspective view of a backrest according to the invention.

FIG. 1 shows a backrest 5 according to the invention. This comprises two parts, i.e. a lower backrest part 3 for supporting the sacral-lumbar part of the back of a seated person and an upper backrest part 2 for supporting the lumbar-thoracic part of the back of the seated person.

The actual lower backrest part 3 comprises a substantially rigid plate 9 and a pressure-distributing layer 8 present on the front side thereof, for instance a cushion of foam with a cover layer arranged thereover.

Both back parts 2 and 3 are carried by carrier 1 of rigid material, which can be coupled by means of clamps 6, pins 7 and the holders 17 indicated in FIG. 2 to for instance the frame of a wheelchair tube 21.

By means of the substantially horizontal slotted holes 14 present in carrier 1, more or less vertical slotted holes 22 present in plate 9, and coupling bolts 13 the plate 9 with layer 8 can be placed, within certain limits, into the desired spatial position relative to carrier 1 with two degrees of freedom of translation, i.e. height and depth, and one degree of freedom of rotation or pivoting.

Carrier 1 further carries a second rigid plate 11, which forms part of the upper backrest part 2 and is provided on its front side with a second pressure-distributing layer 10, which can be of the same type as first pressure-distributing layer 8.

By means of curved slotted holes 14 present in carrier 1 and coupling bolts 13 the plate 11 with layer 10 can be placed within certain limits into the desired spatial position relative to carrier 1 with one degree of freedom of rotation or pivoting.

FIG. 2 shows backrest 5 according to the invention, now however connected by means of clamps 6, pins 7 and holders 17 to two more or less vertical frame tubes 21, with handles, of for instance a wheelchair. Backrest 5 is supported in the height in that pins 7 are suspended in holders 17.

Holders 17 are height-adjustable in that bolt 18 clamps U-shape 20 and fitting piece 19 around frame tube 21. Fin 7 rests in fitting piece 19 during use.

Figure 3:
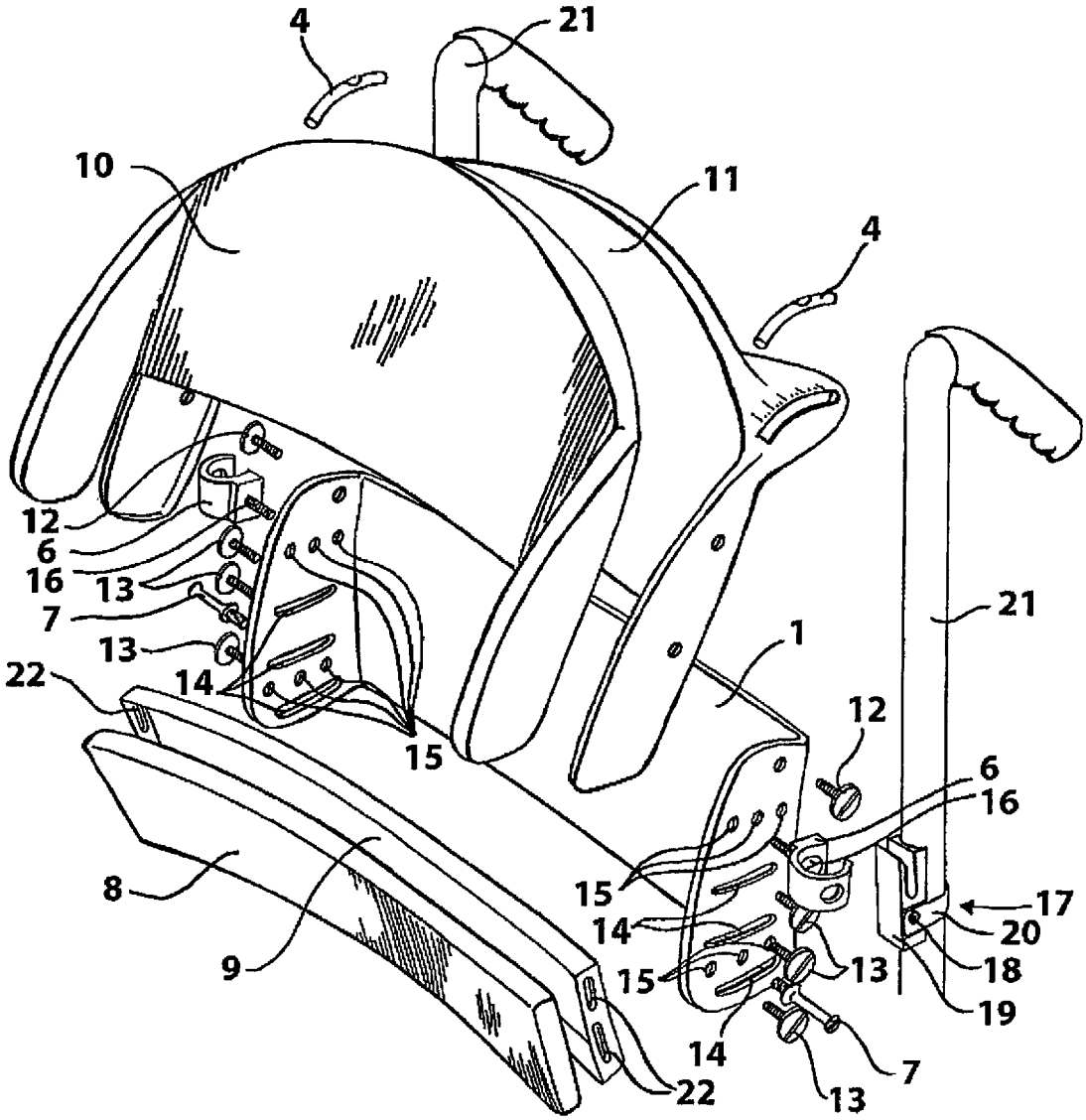
FIG. 3 shows an exploded view of the backrest according to FIG. 1.

FIG. 3 elucidates above stated aspects. It can be seen that left and right-hand bolts 16 can each be fastened at three locations in carrier 1 in the upper series of holes 15 for the purpose of mounting clamps 6 at the desired position in carrier 1. The same applies for left and right-hand pins 7, but then in the lower row of holes 15.

Added on both sides to the second rigid plate 11 is an angle measuring device 4. This may be embodied for instance as a spirit level and indicates the angular position of upper backrest part 10, 11 relative to the horizontal plane.

FIG. 4*a* shows the setting options for determining the height of carrier 1 in continuously variable manner. By means of bolt 18 the holder 17 can be displaced in height to for instance 17', resulting in 1', with the purpose of being able to determine the height of backrest 2 relative to frame tube 21.

FIG. 4*b* shows the setting options for determining the depth of carrier 1 in discrete steps. By means of bolt 16 the clamp 6 can be placed in three positions on carrier 1. Pin 7 can also be placed in three positions. Position 6 and 7 result in position 1, a position in which the backrest is set in the extreme forward position. Position 6' and 7' result in position 1', a position in which the backrest is set in the extreme backward position.

FIG. 4*c* shows the setting options for tilting carrier 1 to 1' by displacing pin 7 to 7'. This provides the option of increasing the tilting range of back parts 3 and 2 relative to the horizontal plane.

FIG. 5 elucidates this aspect further. A seated person 26 is supported by a seat part 23, has placed his feet on a footrest 24, has placed his arms on armrests 25 and his back is supported by the lower backrest part 3 and the upper backrest part 2. Added to the upper backrest part 2 in the above described manner is angle measuring device 4. It will be apparent from FIG. 3 that angle measuring device 4 shows the functional backrest angle ($\nu+\forall$).

FIG. 6*a* shows a straight and unstable back support, while FIG. 6*b* shows a stable back support. These figures show the difference between an unstable torso posture and a stable torso posture. The unstable back support according to FIG. 6*a* can be recognized by the fact that the mass centre M of torso 27 lies in front of the vertical line through pivot point S. In this situation the point M also lies in front of the dotted line through S and T, which represents the position of pelvis 28, while for a stable back support it should lie on or just behind this line.

FIG. 6*b* shows a stable back support. In this situation the mass centre M of torso 27 lies behind vertical line S and on the dotted line through S and T. An anatomically optimal back support is realized with this combination of features.

Further indicated in FIG. 6*b* are two other situations, in which the torso is designated respectively 27' and 27", in which the model occupies respectively a labile back support posture and a posture without any back support.

FIG. 7*a* shows schematically in the shown model the pivot point S between torso 27 and pelvis 28.

FIG. 7*b* shows a realistic representation of a spinal column 29 and pelvis 28 through the median plane of seated person 26. The vertebrae are designated by their systematic scientific names. Attention is drawn to the fact that the pivot point S lies in the vicinity of vertebra L3.

FIG. 7*b* also makes clear the manner in which backrest 5 supports the above specified parts of the back of a seated person 14.

FIG. 7*c* shows the mutual flexural freedom between the vertebrae designated in the figure.

FIG. 7*d* shows the division of spinal column 20 into four segments. From top to bottom these are respectively the cervical segment 30, the thoracic segment 31, the lumbar segment 32 and the sacral segment 33.

With reference to FIGS. 7*a*, 7*b*, 7*c* and 7*d* a brief explanation will now be given as to why a backrest which is segmented and has no pivot axes is necessary.

The model according to FIG. 7 shows an approximation of the biomechanical properties of the human body. The difference between the model and the actual human body is caused by pivot point S and the actual pivoting operation of the spinal column. In reality there is not just one sharply defined pivot axis, but the vertebrae at the position of the pivot point S shown in FIG. 7*b* allow a certain flexure or curvature.

FIG. 7*a* defines pivot point S at a position in the vicinity of the lumbar vertebra three or L3. The model allows this angular rotation, which is also made possible by the vertebral segment between thoracic nine (Th9) and lumbar four (L4). S is in reality therefore not a pivot axis, but L1-L5 together form the pivoting movement between the lower back and the upper back.

As already stated, FIG. 7*b* gives an overview of the spinal column with the individual vertebrae and their scientific designation. FIG. 7*c* indicates the maximum angle of rotation in the lateral plane (flexion/extension) the spinal column allows between adjoining vertebral discs.

FIG. 8*a* shows the manner in which backrest parts 2 and 3 can be displaced. The figure shows that the use of slotted holes 14 in plate 35 with coupling bolts 13 and clamping sleeve 20 round frame tube 21 clamped by bolts 18 provides the option of a continuously variable choice of the position of backrest parts 2 and of setting the pivot position, the height and the depth. A continuously variable choice of back part 3 and setting of the pivot position, the height and the depth are possible in that coupling bolt 34 makes a connection between slot 22 in back part 3 and slot 36 in back part 2.

FIG. 8*b* shows another mechanism wherein backrest parts 2 and 3 are pivotable around respective pivot axes of coupling bolts 13. Similarly to FIG. 8*a*, more or less horizontal slotted holes 14 are used for the required depth adjustment, here however separated into upper and lower plates 35. Once again plates 35, bolts 18 and clamping sleeves 20 provide the option of continuously variable height adjustment relative to frame tube 21. In this embodiment it is however possible to adjust back part 3 wholly independently of 2 without thereby disturbing the position of 3, and vice versa.

FIG. 8*c* shows a variant in which backrest parts 2 and 3 are also adjustable in height, depth and angle by means of pivot arms 40, coupling bolts 13 and slots 22 present at that position. Pivot arms 40 are connected to plates 38 by means of coupling bolts 13 in holes 39. Plates 38 form part of frame tube 21.

FIG. 8*d* shows a variant in which plate 38 forms part of frame 21. The horizontal slots 40 and more or less vertical slots 22 in both back parts 2 and 3 here also provide fully independent adjustment options for depth, height and angle of back parts 2 and 3.

LITERATURE

WO-A-2001/060209
US-A-2003/0102706
"Zo zit het!", dr. ir. H.A.M. Staarink,
ISBN 978 90 232 4341.

The invention claimed is:

1. Backrest for supporting a back of a seated person, which backrest is intended and adapted to form part of an article of seating furniture, a seat for a means of transport, or a wheelchair, characterized in that the backrest consists of two parts, that is:

a lower backrest part for supporting the sacral-lumbar part of the back of the seated person, and an upper backrest part for supporting the lumbar-thoracic part of the back of the seated person, wherein both backrest parts can be moved independently of each other;

a carrier has three degrees of freedom in a vertical plane, perpendicularly of a main plane of the backrest parts, relative to a frame tube, i.e. two degrees of freedom of translation corresponding to height and depth, and one degree of freedom of rotation around a horizontal rotation axis;

relative to the carrier the lower backrest part has three degrees of freedom in a vertical plane perpendicularly of the main plane of the backrest parts, i.e. two degrees of freedom of translation corresponding to height and depth, and one degree of freedom of rotation around a horizontal rotation axis;

relative to the carrier the upper backrest part has one degree of freedom in a vertical plane perpendicularly of the main plane of the backrest parts, i.e. rotation around a horizontal rotation axis;

adjusting means are present for adjusting a spatial position of each of the backrest parts and the carrier to a chosen spatial position; and locking means are present for fixing the carrier and each of the backrest parts in the chosen spatial position;

wherein the lower backrest part comprises a first substantially rigid plate extending continuously from a left side to a right side of the carrier; and the upper backrest part comprises a second substantially rigid plate extending continuously from the left side to the right side of the carrier.

2. Backrest as claimed in claim 1, wherein an angle measuring device is added to at least one of the backrest parts with which an angular position of the at least one of the backrest parts can be measured and read.

3. Backrest as claimed in claim 1, wherein the three degrees of freedom of the lower backrest part are independent of each other relative to the carrier.

4. Backrest as claimed in claim 1, wherein the adjusting means include mechanical, pneumatic or electrical components.

5. Backrest as claimed in claim 1, wherein the backrest is carried by a frame comprising mounting means for mounting on the article of seating furniture, a seat for a means of transport, or a wheelchair.

6. Backrest as claimed in claim 1, wherein both backrest parts are provided on their front side with a pressure-distributing layer.

7. Backrest as claimed in claim 6, wherein the pressure-distributing layer extends from the left side to the right side of the carrier.

8. Backrest as claimed in claim 1, wherein said article of seating furniture includes a chair or a couch.

9. Backrest as claimed in claim 1, wherein said means of transport includes a car, a bus or an aircraft.

10. Backrest as claimed in claim 2, wherein said angle measuring device includes a spirit level.

11. Method for adjusting a backrest, comprising the steps of:

providing a backrest according to claim 1;

adjusting the upper backrest part; and adjusting the lower backrest part, subsequently to the adjusting the upper backrest part, wherein the adjusting the lower back rest part is independent of the adjusting the upper backrest part such that a change in the spatial position of the lower backrest part does not affect the spatial position of the upper backrest part.

12. Backrest for supporting a back of a seated person, which backrest is intended and adapted to form part of an article of seating furniture, a seat for a means of transport or a wheelchair, characterized in that the backrest consists of two parts, that is:

a lower backrest part for supporting the sacral-lumbar part of the back of the seated person, and an upper backrest part for supporting the lumbar-thoracic part of the back of the seated person, wherein both backrest parts can be moved independently of each other;

a carrier has three degrees of freedom in a vertical plane, perpendicularly of a main plane of the backrest parts, relative to a frame tube, that is, two degrees of freedom of translation corresponding to height and depth, and one degree of freedom of rotation around a horizontal rotation axis;

relative to the carrier the lower backrest part has three degrees of freedom in a vertical plane perpendicularly of the main plane of the backrest parts, that is, two degrees of freedom of translation corresponding to height and depth, and one degree of freedom of rotation around a horizontal rotation axis;

relative to the carrier the upper backrest part has one degree of freedom in a vertical plane perpendicularly of the main plane of the backrest parts, that is, rotation around a horizontal rotation axis;

adjusting means are present for adjusting a spatial position of each of the backrest parts and the carrier to a chosen spatial position; and locking means are present for fixing the carrier and each of the backrest parts in the chosen spatial position, wherein an angle measuring device is added to at least one of the backrest parts with which an angular position of the at least one of the backrest parts can be measured and read.

13. Method for adjusting a backrest, comprising the steps of:

providing a backrest according to claim 12;

adjusting the upper backrest part; and adjusting the lower backrest part, subsequently to the adjusting the upper backrest part, wherein the adjusting the lower back rest part is independent of the adjusting the upper backrest part such that a change in the spatial position of the lower backrest part does not affect the spatial position of the upper backrest part.

* * * * *